US006629501B2

(12) United States Patent
McKoy

(10) Patent No.: US 6,629,501 B2
(45) **Date of Patent: *Oct. 7, 2003**

(54) WATERCRAFT AMUSEMENT RIDE

(76) Inventor: Errol W. McKoy, 11844 Preston Brook Pl., Dallas, TX (US) 75230

( * ) Notice: Subject to any disclaimer, the term of this patent is extended or adjusted under 35 U.S.C. 154(b) by 0 days.

This patent is subject to a terminal disclaimer.

(21) Appl. No.: 10/093,067

(22) Filed: Mar. 7, 2002

(65) Prior Publication Data

US 2002/0129731 A1 Sep. 19, 2002

Related U.S. Application Data

(60) Division of application No. 09/784,595, filed on Feb. 15, 2001, now Pat. No. 6,354,223, which is a division of application No. 09/281,740, filed on Mar. 30, 1999, now Pat. No. 6,237,499, which is a continuation-in-part of application No. 09/050,810, filed on Mar. 30, 1998, now Pat. No. 5,860,364, which is a continuation-in-part of application No. 08/661,365, filed on Jun. 11, 1996, now Pat. No. 5,732,635.

(51) Int. Cl.[7] ..... A63G 21/00

(52) U.S. Cl. ..... 104/72; 104/53; 104/60; 104/73

(58) Field of Search ..... 104/53, 72, 60, 104/59, 70, 73, 85, 69; 472/117, 128; 463/64

(56) References Cited

U.S. PATENT DOCUMENTS

| | | | | |
|---|---|---|---|---|
| 357,790 A | | 2/1887 | Schaefer | |
| 536,357 A | | 3/1895 | Palacio | |
| 536,441 A | * | 3/1895 | Morris | 104/70 |
| 849,970 A | * | 4/1907 | Boyton | 104/35 |
| 1,358,305 A | | 11/1920 | Feltman | |
| 1,397,939 A | | 11/1921 | Unger | |
| 1,448,306 A | | 3/1923 | Lezert | |
| 3,003,430 A | | 10/1961 | Hamel | |
| 3,404,635 A | * | 10/1968 | Bacon et al. | 104/70 |
| 3,577,928 A | | 5/1971 | Victorri | |
| 3,690,265 A | | 9/1972 | Horibata | |
| 3,697,071 A | * | 10/1972 | Anderson | 104/155 |
| 3,802,697 A | * | 4/1974 | Le Mehaute | 482/51 |
| 3,830,161 A | * | 8/1974 | Bacon | 104/70 |
| 3,834,316 A | | 9/1974 | Hennings | |
| 3,838,657 A | | 10/1974 | Fleming | |
| 3,841,227 A | | 10/1974 | Fink | |
| 3,853,067 A | | 12/1974 | Bacon | |
| 3,854,415 A | | 12/1974 | Lamberet | |
| 3,930,450 A | | 1/1976 | Symons | |
| 4,149,469 A | | 4/1979 | Bigler | |
| 4,299,171 A | | 11/1981 | Larson | |
| 4,337,704 A | | 7/1982 | Becker et al. | |
| 4,392,434 A | | 7/1983 | Durwald et al. | |
| 4,725,398 A | | 2/1988 | Ruckey et al. | |
| 4,805,896 A | | 2/1989 | Moody | |
| 4,823,705 A | | 4/1989 | Fukuda | |

(List continued on next page.)

FOREIGN PATENT DOCUMENTS

| | | |
|---|---|---|
| CH | 192742 | 11/1937 |
| DE | 398913 | 7/1924 |
| EP | 280336 | 8/1988 |

*Primary Examiner*—Mark T. Le
(74) *Attorney, Agent, or Firm*—Dennis T. Griggs

(57) ABSTRACT

Passenger boats are mounted on an undercarriage assembly that includes rail-mounted centering wheels. The passenger boats are accelerated by linear induction drive motors mounted on a guide rail structure. Thrust is applied to the racing boats by magnetically conductive reaction plates that are attached to the undercarriage assembly and are movable through linear flux slots formed in the induction stators of the linear induction motors. The submerged guide track structure is arranged in various closed loop courses, including "Figure-Eight," an hour-glass, serpentine and oval patterns, as well as parallel guide track structures that extend between a launch station and a return station. A dual "Figure-Eight" watercourse includes a simulated jump ramp and an underground tunnel arrangement. In the continuous loop guide structure, two or more boats are launched and separation is maintained by a safety block arrangement.

6 Claims, 8 Drawing Sheets

U.S. PATENT DOCUMENTS 4,895,079 A 1/1990 Beatty
4,963,116 A * 10/1990 Huber ..... 446/153
5,011,134 A 4/1991 Langford
5,215,016 A 6/1993 Futami
5,230,662 A * 7/1993 Langford ..... 472/117
5,234,285 A 8/1993 Cameron
5,299,964 A 4/1994 Hopkins
5,421,792 A 6/1995 Lochtefeld
5,613,443 A 3/1997 Ariga
5,651,736 A * 7/1997 Myers ..... 463/59
5,794,533 A 8/1998 Takai
6,354,223 B2 * 3/2002 McKoy ..... 104/72

* cited by examiner

WATERCRAFT AMUSEMENT RIDE

CROSS-REFERENCE TO RELATED APPLICATIONS

This divisional application claims priority under 35 U.S.C. §120 from the following applications:

U.S. application Ser. No. 09/784,595 filed Feb. 15, 2001 (U.S. Pat. No. 6,354,223), which is a divisional of U.S. application Ser. No. 09/281,740, filed Mar. 30, 1999 (U.S. Pat. No. 6,237,499), which is a continuation-in-part of U.S. application Ser. No. 09/050,810, filed Mar. 30, 1998 (U.S. Pat. No. 5,860,364), which is a continuation-in-part of U.S. application Ser. No. 08/661,365, filed Jun. 11, 1996 (U.S. Pat. No. 5,732, 635).

STATEMENT REGARDING FEDERALLY SPONSORED RESEARCH OR DEVELOPMENT

Not applicable

BACKGROUND OF THE INVENTION

This invention relates generally to amusement watercraft, and in particular to a passenger boat ride in which passenger boats are propelled along a submerged guide channel from a ground level launch or from an inclined launch across or around a watercourse.

Amusement parks and theme parks such as Six Flags Over Texas, Opryland U.S.A., Cedar Point, Carowinds, Busch Gardens, Geauga Lake, Elitch Gardens and many others feature various watercraft rides that are guided safely through natural and man-made waterways. Some watercraft rides that are currently popular include a floating gardens ride, a river rapids ride, a log flume ride and a mill chute ride.

In a typical watercraft ride, a passenger boat is guided along a water channel from a passenger loading station to one or more intermediate stations and back to the passenger loading station. Such boats are usually propelled in part by water currents, gravity or passenger manpower, although some are propelled by motor-driven chains. Generally, variations such as music, sound effects, lighting effects, stage props and costumed characters enhance the entertainment value of the ride.

Some dominant concerns in the operation of such rides include the creation of a sense of fun and excitement while maintaining passenger safety, reliable equipment operation and expedited handling of passengers during loading and off-loading.

Conventional watercraft amusement rides are described in the following patents:

| U.S. Pat. No. | Inventor | Title of Invention |
|---|---|---|
| 357,790 | Schaefer | Marine Boat Slide |
| 849,970 | Boyton | Amusement Device |
| 3,404,635 | Bacon et al | Boat Amusement Ride |
| 3,830,161 | Bacon | Flume Boat Ride with a Double Downchute |
| 4,392,434 | Durwald et al | Turbulent Waterway |
| 3,853,067 | Bacon | Boat Amusement Ride with a Spillway |
| 4,299,171 | Larson | Demountable Flume Amusement Ride |
| 4,337,704 | Becker | Turbulent-Water Way |
| 4,149,469 | Bigler | Log Braking and Stabilizing System for Log Flume Ride |
| 5,011,134 | Langford | Waterslide with Uphill Run and Flotation Device Therefor |
| 3,690,265 | Horibata | Aquatic Sled and Shooting Apparatus Thereof |
| 5,299,964 | Hopkins | Amusement Raft Ride |
| 4,836,521 | Barber | Whirlpool Amusement Ride |
| 5,069,443 | Shiratori | Water Slider Lane |
| 5,282,772 | Ninomiya | Simulator for Shooting Down the Rapids |
| 4,391,201 | Bailey | Aquatic Toboggan Slide |
| 4,543,886 | Spieldiener | Amusement Ride Including a Rotating Loading Terminal |
| 3,923,301 | Myers | Amusement Water Slide and Method |
| 3,930,450 | Symons | Boat Ride for Amusement Park |
| 5,213,547 | Lochtfeld | Method and Apparatus for Improved Water Rides by Water Injection and Flume Design |
| 4,516,943 | Spieldiener | Amusement Ride Raft |

These patents disclose various watercraft amusement rides in which a passenger boat is propelled through a flume or guided down an inclined launch, and then recovered. For example, U.S. Pat. No. 849,970 discloses an inclined launch in which a pair of passenger boats is winched up dual tracks by sprocket-driven chains, is reversed on a turntable and then permitted to descend the launch by the force of gravity along the inclined tracks into a splash lake. The boats are guided by wheels along the guide tracks during descent.

U.S. Pat. No. 3,830,161 discloses a flume boat ride having dual launch chutes that guide amusement boats through a shallow body of water. A similar boat ride is shown in U.S. Pat. No. 3,404,635 in which a pair of passenger boats is guided from an elevated passenger loading station along dual tracks into a waterway.

U.S. Pat. No. 4,392,434 discloses an amusement boat ride in which a passenger boat is pulled by a chain drive to a launch station above a turbulent waterway. The passenger boat is then released from the chain drive and travels by gravity on guide wheels that roll along a guide track.

Conventional watercraft rides as exemplified by the patents discussed above broadly disclose the concept of guiding one or more amusement boats from an elevated launch into a waterway.

The operators of amusement parks are constantly striving to provide safe, yet thrilling and entertaining boat rides. Accordingly, there is a continuing interest in providing novel watercraft rides that offer passengers a memorable and exciting ride experience under closely controlled, safe operating conditions.

BRIEF SUMMARY OF THE INVENTION

The amusement boat ride according to a first embodiment of the present invention is a simulated boat race in which pairs of racing boats compete in forward and return heats. Novel combinations of sudden acceleration/deceleration, high velocity travel, reversal of movement, exposure to lighting effects, sound effects, water spray and group competition provide a sense of excitement and fun. The passengers of each boat are subjected to high launch velocity, high speed hydroplaning across a splash lake, and giant water spray rooster tails that, in the spirit of good fun, spray onto passengers of the competing boat as well as onto nearby spectators. The passenger boats are propelled along parallel guide channels from one launch station to the other by linear induction motor that are structurally integrated with the passenger boat undercarriage and the submerged guide channels.

According to an alternative amusement ride of the present invention, pairs of passenger boats are launched from a first pair of inclined launch ramps and are propelled by linear induction motors along guide rails into a shallow splash lake. The passenger boats are then accelerated along the parallel guide channels by the linear induction motors so that the boats hydroplane across the splash lake. The linear induction motors propel the passenger boats partially up a second pair of inclined launch ramps on the opposite end of the splash lake to a predetermined return launch elevation.

Upon reaching the return launch elevation, the direction of thrusting force is reversed and the passenger boats are propelled rapidly down the inclined launch ramps with the passengers facing away from the direction of return travel. The passenger boats are then propelled along the guide channels across the shallow splash lake at hydroplaning speed, followed by coasting at a reduced speed to the passenger loading station.

In each embodiment, the passenger boats are stabilized by centering wheels and guide rollers that travel along submerged rails that run in parallel along the guide channels. In one arrangement, the linear induction motors include stators that are mounted laterally offset from the guide rails and in tandem relation with each other along opposite sides of each guide channel. In another arrangement, the linear induction motor stators are mounted on the rail support structure and vertically offset and centered beneath the undercarriage assembly in tandem relation with each other along the rail guide structure. In this arrangement, a reaction plate is attached to the undercarriage assembly and projects vertically into the stator flux slots.

Each linear induction motor includes a stator having a linear magnetic flux slot for receiving a reaction plate. The passenger boat is attached to an undercarriage assembly that is movably coupled to the guide rails by the centering wheels and rollers. Two reaction plates are attached to the undercarriage assembly and project laterally into the stator flux slots. Each stator, when energized with AC electrical current, produces electromagnetic flux waves that travel longitudinally through each flux slot. The electromagnetic forces imposed on the reaction plates produce linear thrust which drives the undercarriage assembly and passenger boat along the guide rails.

BRIEF DESCRIPTION OF THE DRAWING

The accompanying drawing is incorporated into and forms a part of the specification to illustrate the preferred embodiments of the present invention. Throughout the drawing, like reference numerals designate corresponding elements. This drawing, together with the description, serves to explain the principles of the invention and is only for the purpose of illustrating exemplary embodiments showing how the invention can best be made and used. The drawing should not be construed as limiting the invention to the illustrated and described embodiments. Various advantages and features of the invention will be understood from the following detailed description taken in connection with the appended claims and with reference to the attached drawing in which:

DETAILED DESCRIPTION OF THE INVENTION

Figure 1:
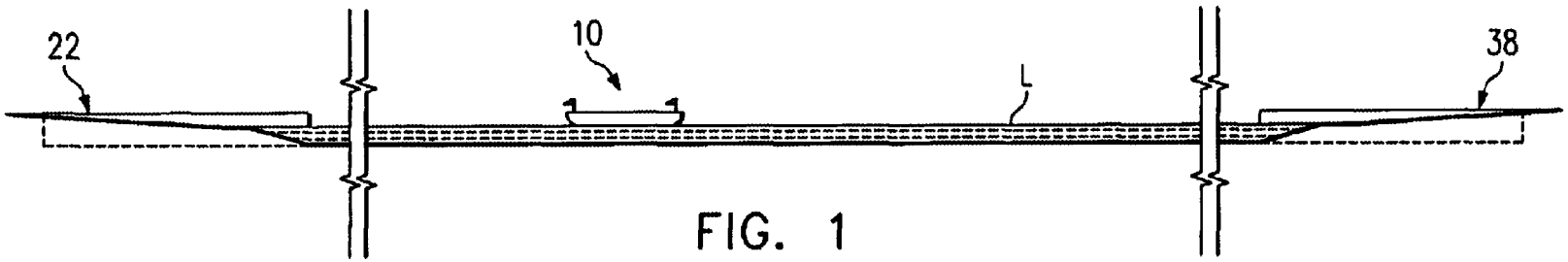
FIG. 1 is a simplified side elevational view of a simulated racing boat ride having launch stations on opposite ends of a splash lake.
Figure 2:
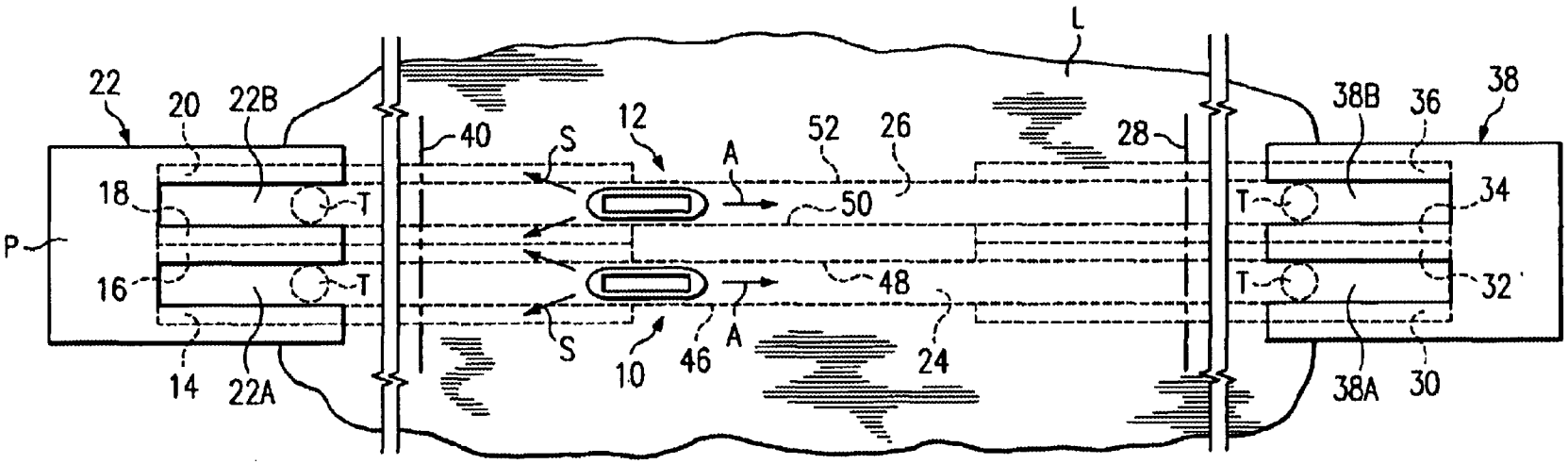
FIG. 2 is a top plan elevational view thereof.

Preferred embodiments of the present invention are described herein by referring to various examples of how the invention can be made and used. Like reference numerals are used throughout the description and several views of the drawing to indicate like or corresponding parts.

In the description which follows, like parts are marked through the specification and drawings with the same reference numerals, respectively. The drawing figures are not necessarily to scale, and the proportions of certain parts have been exaggerated for sake of clarity.

Referring now to FIGS. 1–4, a simulated boat race is conducted in first and second heats in which racing boats 10, 12 are propelled by first and second pairs of linear induction motors 14, 16 and 18, 20, respectively, from a forward launch station 22 at a hydroplaning speed, for example 40 m.p.h., along parallel guide channels 24, 26 across a shallow splash lake L to a first heat finish line 28. Large (twenty feet high) water spray rooster tails follow the passenger boats across the lake. The winning time of the first heat is announced and displayed on an electronic score board. The racing boats 10, 12 are then propelled at a coasting speed by a second set of linear induction motors 20, 32 and 34, 36 to a return launch station 38 on the opposite end of the splash lake.

The racing boats are held steady at the return launch station 38 during a second heat countdown, and then are suddenly accelerated by the second set of linear induction motors along the guide channels 24, 26 into the shallow splash lake L in the reverse (return) direction to the second heat finish line 40. The winning time of the second heat is then announced and displayed. The passengers remain facing the return launch station (opposite to the direction of return travel) during the return heat as the racing boats hydroplane across the splash lake, thus permitting the passengers to watch closely as both boats generate the giant water spray rooster tails.

Figure 3:
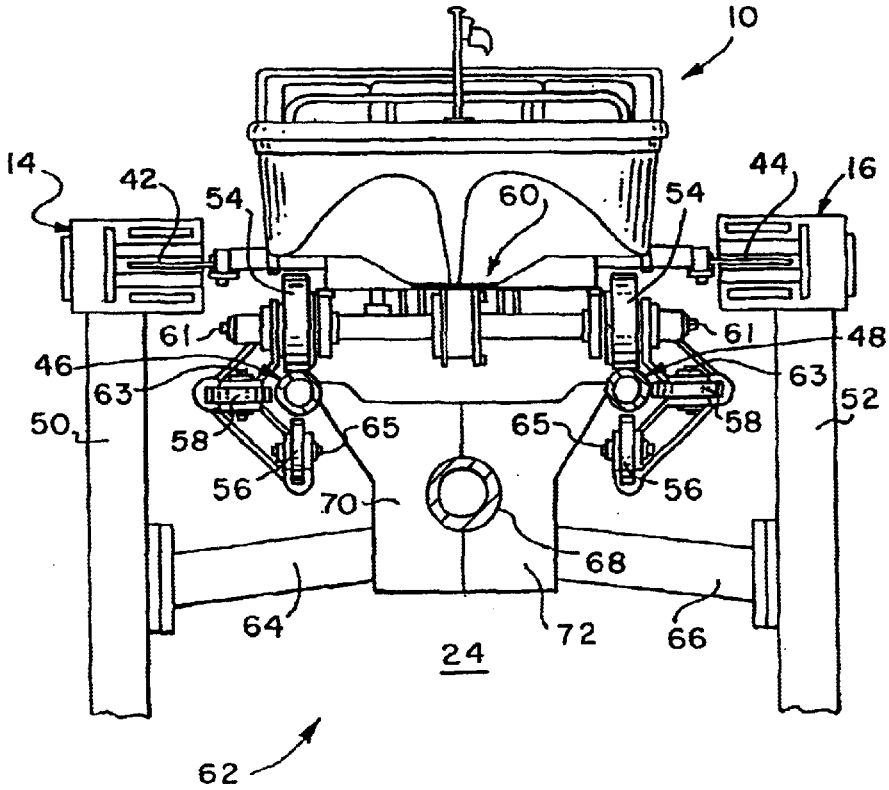
FIG. 3 is a front elevational view of a racing boat mounted on guide rails and magnetically coupled to a pair of linear induction motors.
Figure 4:
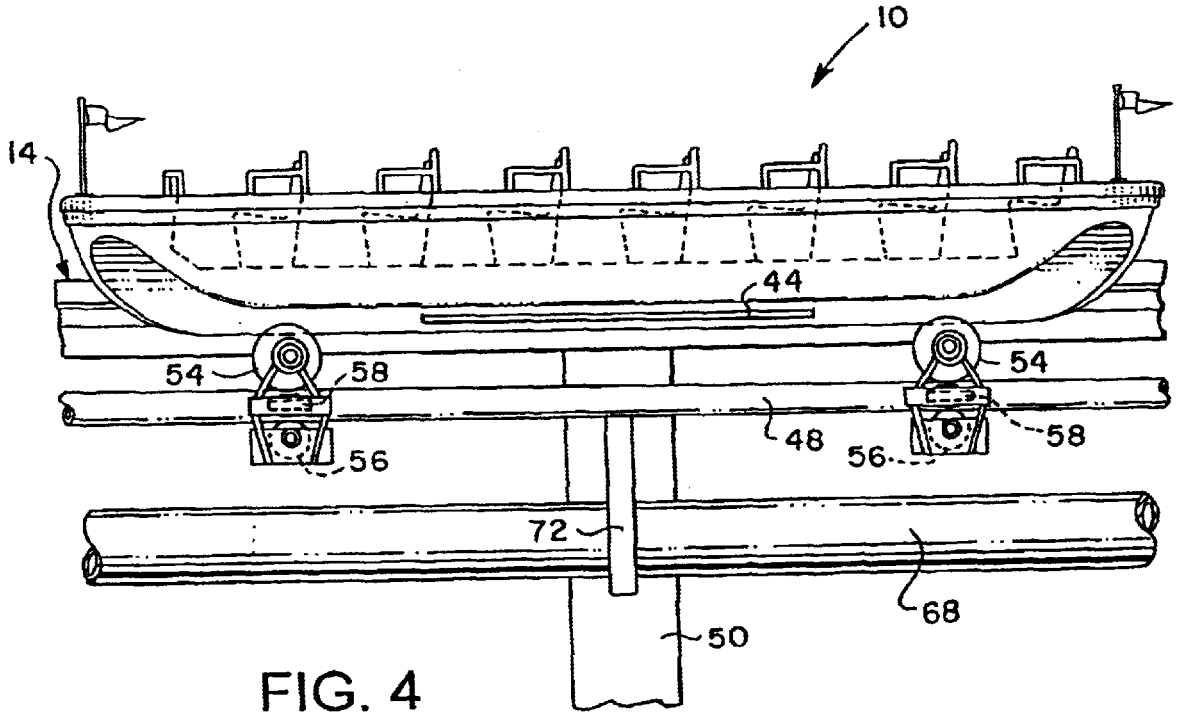
FIG. 4 is a side elevational view thereof.
Figure 6:
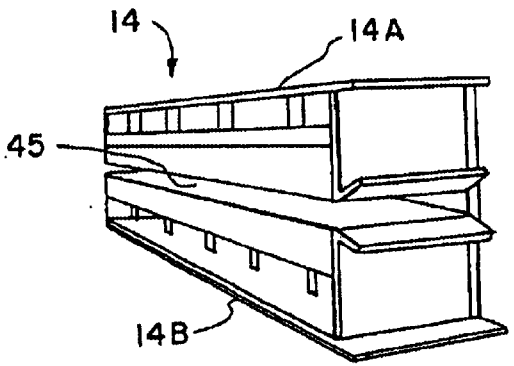
FIG. 6 is a side perspective view of a linear induction motor.
Figure 8:
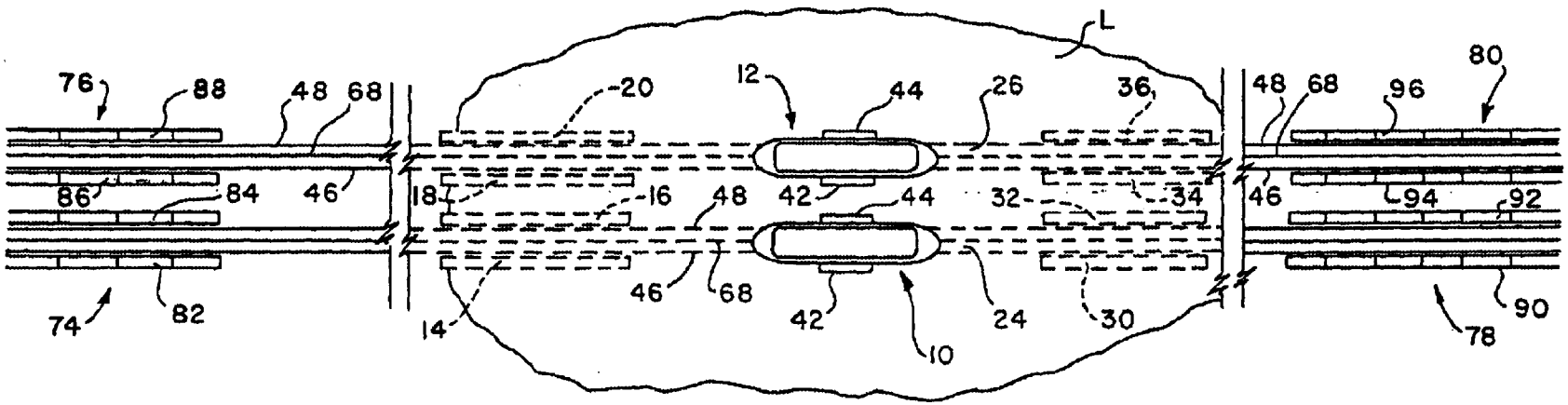
FIG. 8 is a top plan view thereof.

The racing boats 10, 12 are propelled along the parallel guide channels 24, 26 by the linear induction motors 14, 16 that are magnetically coupled to each racing boat, respectively, by laterally projecting reaction plates or fins 42, 44 (FIG. 3, FIG. 4 and FIG. 8). Referring now to FIG. 3 and FIG. 6, each group of linear induction motors, for example group 14, include forty linear induction motor units mounted in tandem relation. The linear induction motor construction shown in FIG. 6 is typical, with the linear induction motor 14 including a pair of linear stators 14A, 14B separated by a narrow, linear flux slot 45. Each stator includes slotted, laminated steel core members which are wound with three-phase winding coils that are energized with alternating current from a three-phase source.

When the magnetically conductive reaction plates are present in the flux slots, currents are induced in the reaction plates and produce a reaction flux wave of the same magnetic polarity as the stator flux wave. The reaction wave forces the reaction plate in the same direction as the stator flux wave is traveling. The interaction of the stator and reaction plate flux waves produce forces in the longitudinal direction and in the normal direction. The longitudinal thrust force moves the reaction plate in direction of the traveling flux wave. The normal force levitates the reaction plate. As a result, the reaction plate achieves equilibrium velocity when the thrust exerted on it by the traveling flux wave is balanced by the restraining drag load imposed by the undercarriage and the passenger boat.

The linear induction motors maintain positive control of the speed and relative positions of the racing boats during acceleration and braking. The dual launch stations 22, 38 on opposite ends of the shallow splash lake L permit the passengers to experience rapid acceleration and hydroplaning across the splash lake at a high speed to the forward heat finish line 28, followed by hydroplaning across the splash lake at a high speed in the reverse (return) direction to the return heat finish line 40, with the boats being guided along parallel rails 46,48 and 50,52 during both heats.

Prior to the start of the first heat, the passengers are loaded onto the racing boats 10,12 from a ground level staging platform P. After passenger loading has been completed, the racing boats 10,12 are held in launch pens 22A, 22B at the forward launch station 22 during the forward heat countdown. Upon launch, the racing boats are accelerated along the guide channels 24,26 by the linear induction motors 14,16 and 18,20. As the racing boats exit the forward launch, they hydroplane across the shallow lake L at a high speed, for example 40 miles per hour, thus creating giant water spray rooster tails as they approach the forward heat finish line 28.

After the racing boats 10,12 cross the forward heat finish line, the linear induction motors 30,32 and 34,36 continue to drive the racing boats at a reduced (coasting) speed, for example 5 m.p.h., along the drive channels to the return launch station 38 on the opposite end of the splash lake. The racing boats are held in launch pens 38A,38B during a second heat countdown and then are accelerated rapidly along the guide channels while the passengers remain facing the return launch station so that they can observe the water spray rooster tails. The racing boats 10,12 hydroplane across the shallow lake at a high speed, for example 40 mph, to the return heat finish line 40. The racing boats are then propelled by the linear induction motors 14,16 and 18,20 at a coasting speed, for example 5 m.p.h., to the staging platform P where the passengers are off-loaded and new passengers are admitted for the next race.

Hydraulically actuated turntables T are submerged in the launch pens 22A,22B and 38A,38B. When actuated, the turntables T elevate the passenger boats above the deck surfaces of the loading platforms 22,38 and turn the passenger boats through 180 degrees so that the passengers are facing in the direction of travel during the return heat.

Preferably, each heat of the simulated boat race is accompanied by giant voice (public address) messages announcing departure, countdown, timing lights that indicate various stages during the countdown and loud warning signals prior to launch. Synchronized sound effects and flashing light effects accentuate the acceleration of the launch. Compressed steam is released at each launch station as the racing boats initially accelerate across the splash lake. An electronic scoreboard flashes the winning time as the racing boats are guided under linear induction motor control to each launch station. The special effects are repeated as the racing boats are propelled from the return launch station to the second heat finish line 40.

Referring now to FIG. 3 and FIG. 4, the linear induction motors 14, 16 are mounted on support posts 50,52 in parallel alignment with the guide rails 46,48. High velocity movement of each passenger boat is stabilized laterally and vertically by multiple sets of centering guide wheels 54,56 and 58 (FIG. 4) that are mounted on an undercarriage 60 beneath each racing boat. The guide wheels are mounted for rotation on axles 61,63 and 65, respectively.

Lateral movement of each racing boat is opposed by the centering wheels 58 and vertical movement is opposed by the centering wheels 54,56. As shown in FIG. 3, the centering wheels ride on the tubular rails 46,48. The guide wheels are captured for rolling movement along the guide rails thus maintaining the racing boats centered horizontally within their respective guide channels 24,26 and vertically in alignment with the linear induction motors.

The guide rails 46, 48 form continuous runways along the guide channels 24,26. The guide wheels 54 are mounted on the main axle 61 for rolling movement along the guide rails 46,48 with lateral movement being opposed by the centering wheels 58. Downward (bottoming) movement of each passenger boat is opposed by rolling engagement of the upper guide wheels 54 against the top surface of the guide rails. Upward (pitching) movement of each passenger boat is opposed by engagement of the lower guide wheels 56 against the underside of the guide rails 46,48.

Referring again to FIG. 3 and FIG. 4, a guide channel structure 62 is formed by a tubular weldment which is submerged within the splash lake L. The guide rails 46,48 are formed by continuous tubular beams that are elevated from the lake bed by struts 64,66, respectively. The struts and guide rails are connected to a central support beam 68 by gusset plate weldments 70,72. Opposite ends of the struts are welded to the support posts 50,52.

Figure 5:
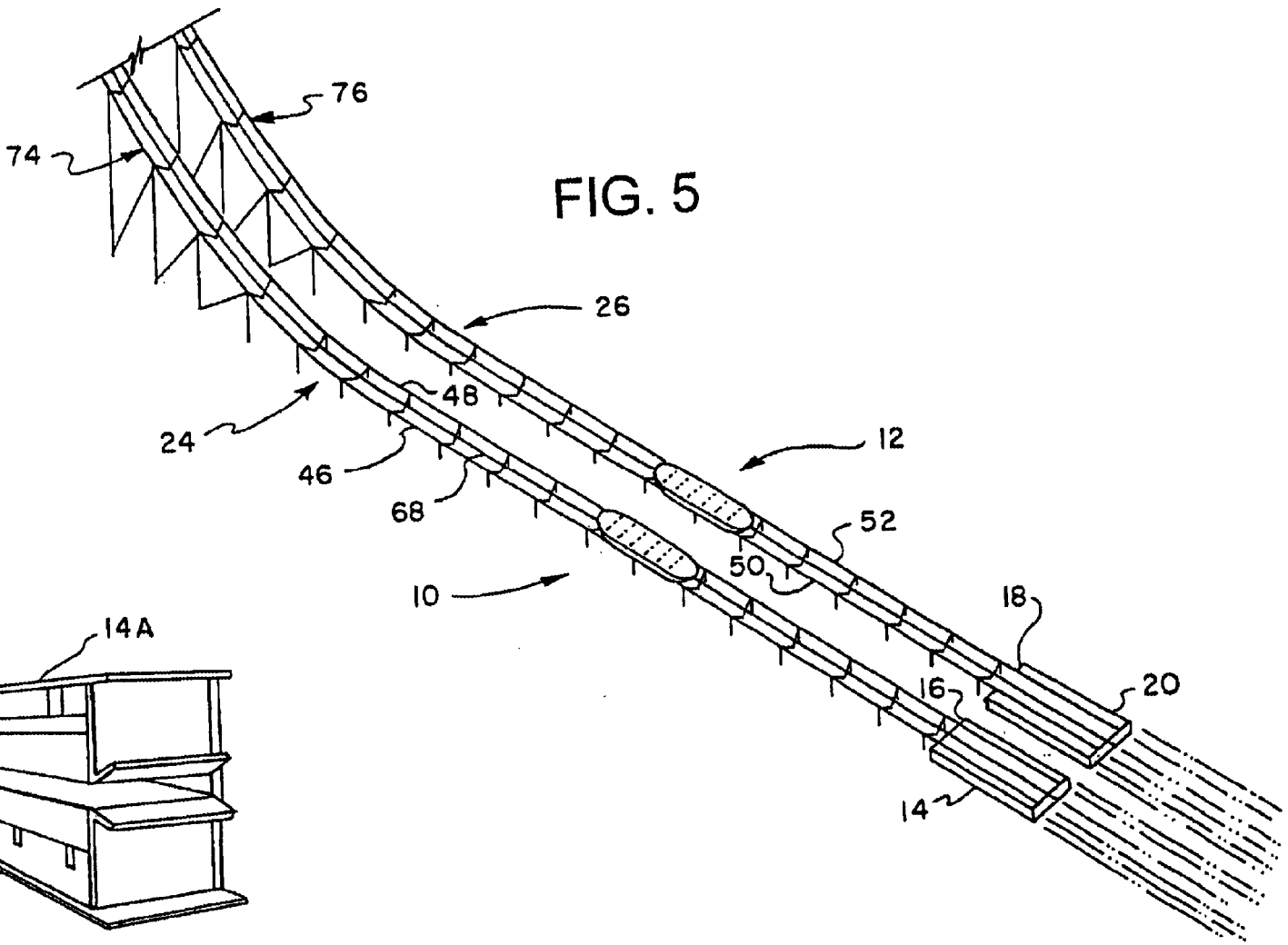
FIG. 5 is a simplified perspective view of an inclined launch ramp.
Figure 7:
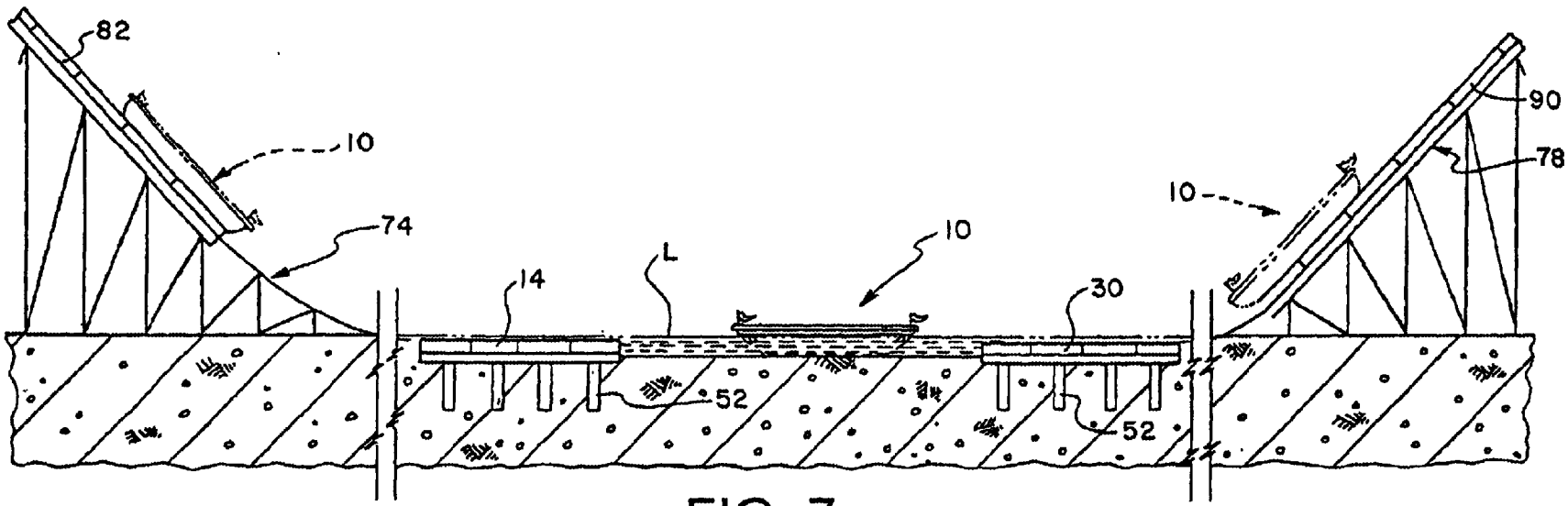
FIG. 7 is a side elevational view showing an amusement boat ride in which passenger boats are driven by linear induction motors through a splash lake situated between a pair of inclined launch ramps.

Referring now to FIG. 5, FIG. 7 and FIG. 8, an alternative amusement ride of the present invention includes a first pair of inclined launch ramps 74,76 located adjacent one end of the splash lake L. A second pair of inclined launch ramps 78,80 are located on the opposite end of the splash lake L in alignment with the guide channels 24,26, respectively. Groups of linear induction motors 14,16; 18, 20; 30,32; and 34,36 are submerged within the splash lake in the same manner as described with reference to the FIG. 2 amusement ride embodiment.

In this embodiment, aligned groups of linear induction motors 82,84; 86,88; 90,92; and 94,96 are installed laterally adjacent the guide rails on the scaffolding that supports the inclined ramps. According to this amusement ride arrangement, the passenger boats are propelled by the submerged linear induction motors from the splash lake L upwardly along the inclined ramp 74. The momentum of the passenger boats carry them into magnetic coupling alignment with the elevated linear induction motors 82,84, and 86,88. The reaction plates 42,44 are magnetically coupled with the traveling linear magnetic flux wave, thus propelling the passenger boats up the inclined ramp 74 to a predetermined launch elevation, for example a height of 70 feet.

Upon reaching the launch elevation, the direction of thrust is reversed and the elevated linear induction motors propel the passenger boats rapidly down the inclined launch ramp 74 into the shallow splash lake. The passenger boats 10, 12 are then accelerated along the parallel guide channels 24, 26 by the submerged linear induction motors so that the passenger boats hydroplane at a high speed, for example 40 mph, across the splash lake toward the inclined ramps 78,80. As the passenger boats enter the flux zone of the second group of submerged linear induction motors, they are accelerated again and the momentum carries them partially up the inclined ramps 78,80 until the radially projecting reaction plates 42,44 become magnetically coupled with the elevated linear induction motors, which propel the passenger boats up the inclined launch ramps to a predetermined return launch elevation.

Upon reaching the return launch elevation, the direction of thrusting movement is reversed and the passenger boats are propelled rapidly down the inclined return ramps 78, 80 with the passengers facing away from the direction of return travel. The reaction plates 42,44 once again become magnetically coupled to the submerged linear induction motors 30, 32 and 34, 36, and the passenger boats are quickly accelerated to hydroplaning speed. The passenger boats 10, 12 coast at hydroplaning speed until their laterally projecting reaction plates become magnetically coupled with the submerged linear induction motors 14,16 and 18,20, whereupon their coasting speed is reduced for safe entry into the passenger loading station.

Figure 9:
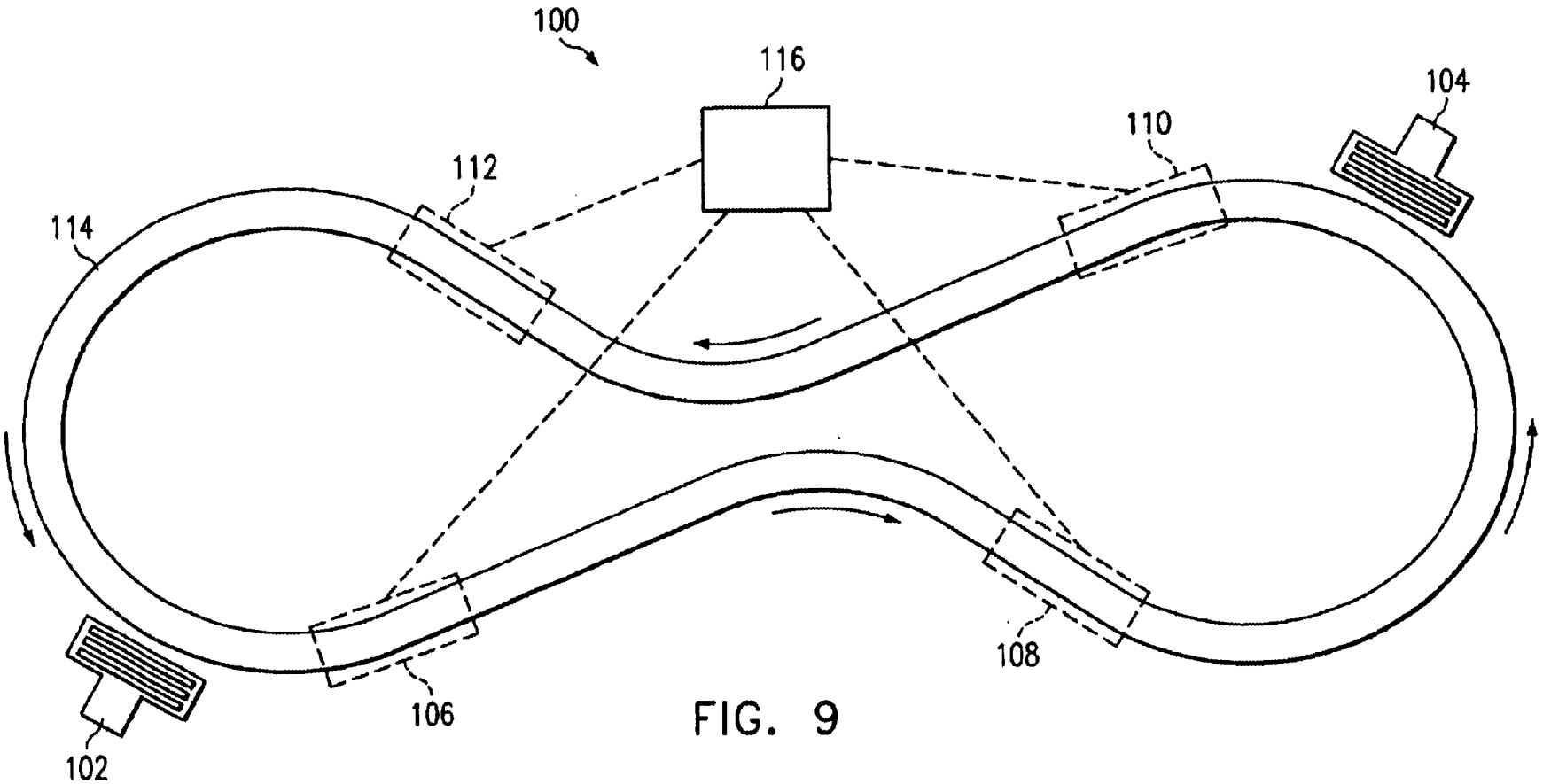
FIG. 9 is a top plan view showing an amusement boat ride in which passenger boats are propelled across a splash lake along a continuous loop, figure-8 guide channel situated between a pair of launch ramps.

Referring now to FIG. 9, a continuous loop guide structure 100, arranged in the general form of an hour glass pattern, is submerged in the watercourse and provides a continuous guide channel from a first passenger loading station 102 to a second passenger loading station 104. Multiple linear induction motor groups 106, 108, 110 and 112 each include a stator component mounted on the guide structure 114 for propelling one or more passenger boats through the watercourse. Preferably, the guide channel structure a dual guide rail support arrangement shown in FIG. 3 and FIG. 4, and the passenger boats are supported for rolling movement along the guide rails on and undercarriage assembly.

When multiple passenger boats are launched, a safety release system 116 coordinates the release and speed of each passenger boat under microprocessor and limit switch control thereby maintaining a safe operating separation between the passenger boats at all times.

Figure 11:
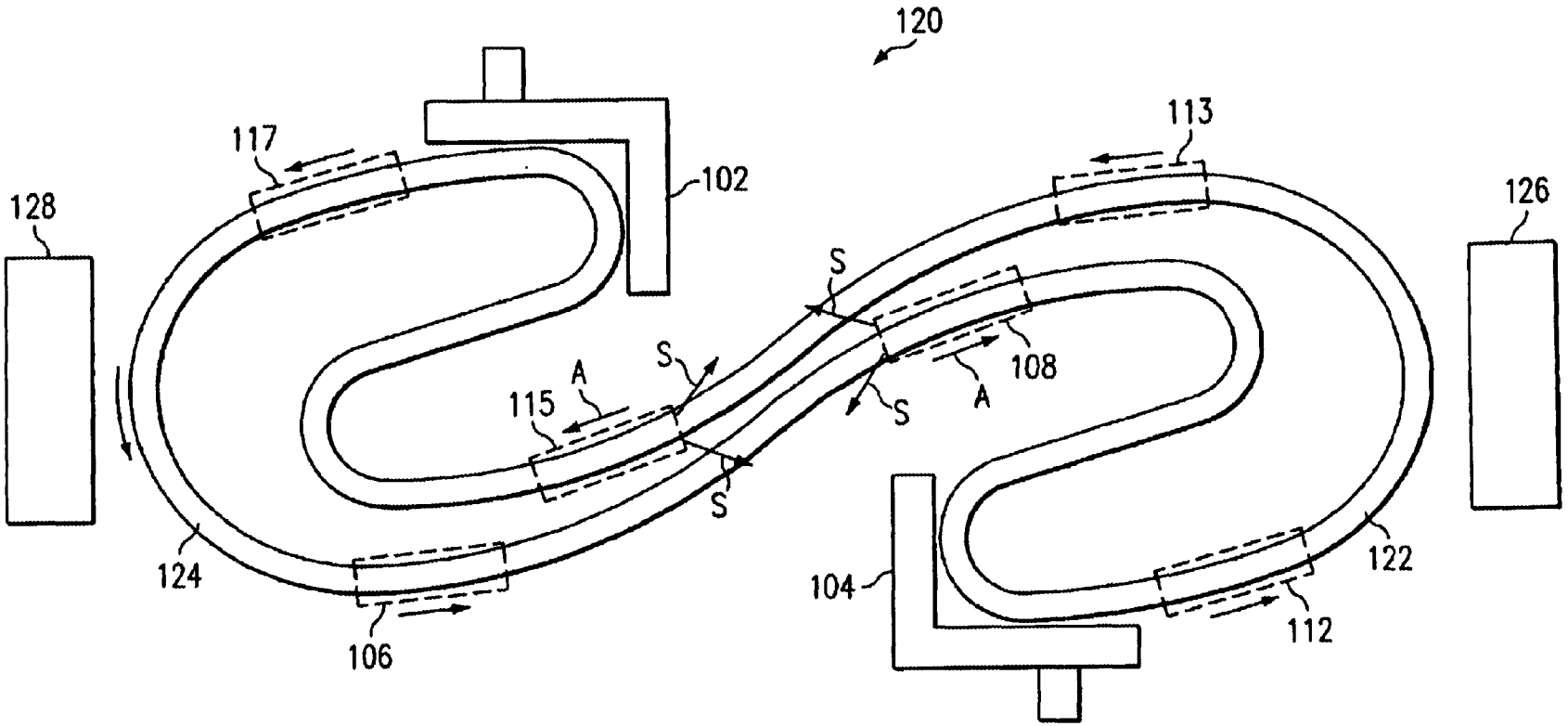
FIG. 11 is a top plan view of a continuous loop, submerged guide channel which extends in a Figure-S pattern between a pair of launch stations.

In the continuous loop embodiment, the guide structure can assume various configurations such as the dual "Figure 8" arrangement 118 and the serpentine pattern 120 shown in FIG. 11. Other closed loop arrangements, including oval and circular patterns, can be used to good advantage.

Referring again to FIG. 9, passengers are transported through a watercourse 100 comprising a guide structure 114 submerged in the watercourse and arranged in an hour-glass pattern. Passenger boats are launched from loading platforms 102,104 at opposite ends of the guide channel structure. The safety release system 116 coordinates the release and operating speed of the boats so that they close toward each other and in passing at the midpoint of the hour-glass pattern, project water spray onto the other boat as they recede from each other.

Referring now to FIG. 11, passengers are transported on two or more passenger boats through a watercourse including a serpentine guide structure 120 submerged in the watercourse and arranged in a closed loops including oval loop portions 122,124 that are banked or inclined with respect to spectator stands 126,128. The passenger boats are banked around the inclined loops and spray the spectator stands with water as each passenger boat transitions through the turn. The serpentine guide structure 120 has first and second curved sections extending generally in side-by-side relation with each other between the looped end portions 122, 124. The launching and operating speed of each boat relative to the other are controlled so that the boats approach and pass in close proximity to each other and then recede from each other as they travel along the loop sections. Each boat projects water spray S onto the other boat as the boats recede from each other in opposite directions of travel, as indicated by the arrows A.

Referring again to FIG. 1 and FIG. 2, passengers are transported on first and second passenger boats 10, 12 along a watercourse including first and second guide structures 24,26 submerged in the watercourse and extending from the first launch station 22 to the second launch station 38. During the forward and reverse heats, the speed of each boat is controlled so that one boat overtakes and passes the other substantially at the midpoint of the watercourse, and project water spray S onto the other boat as the passenger boats recede from each other while moving in the same direction of travel, as indicated by the arrows A.

Figure 10:
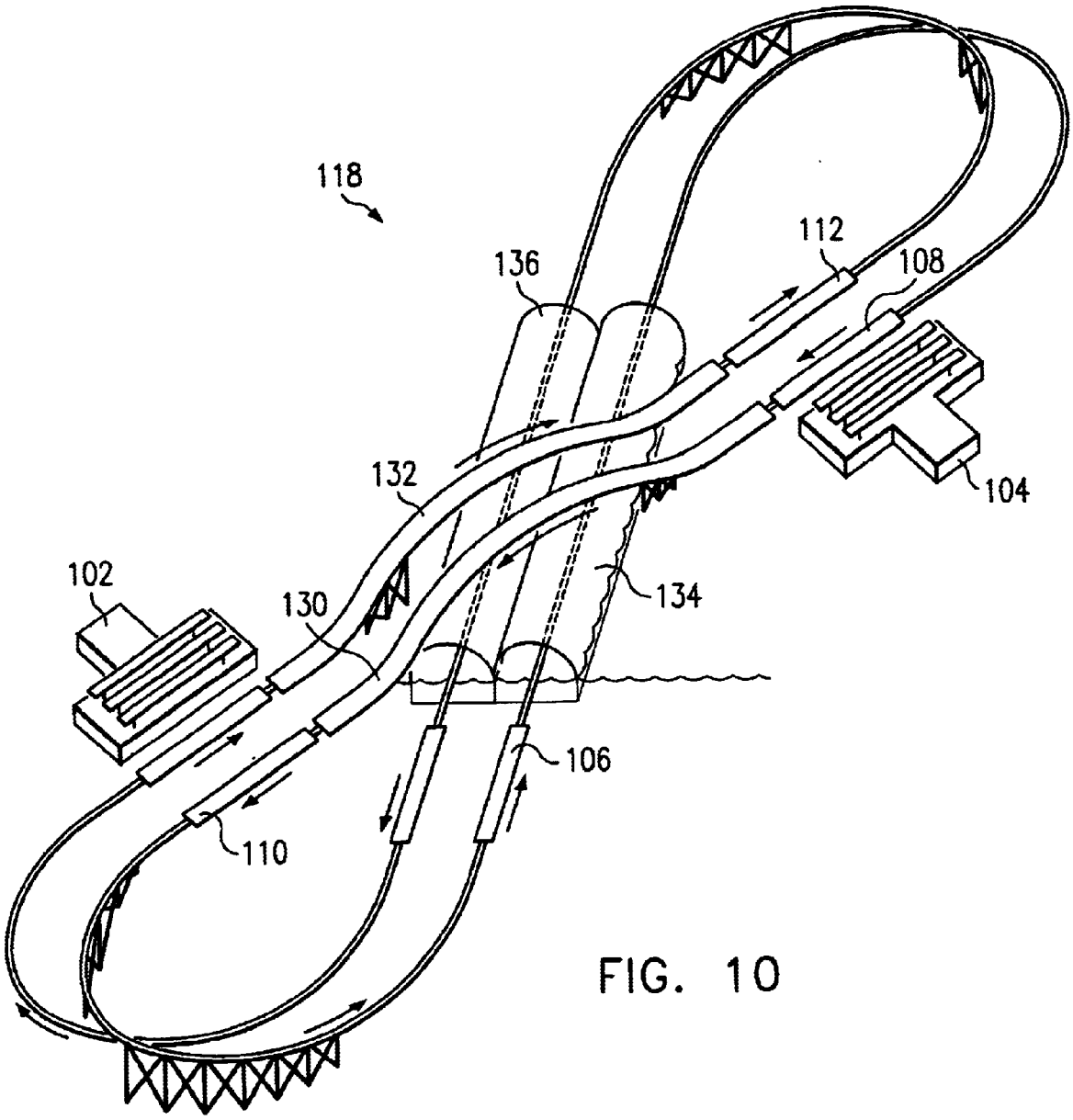
FIG. 10 is a perspective view showing an amusement boat ride in which passenger boats are propelled across a splash lake along submerged and elevated guide channels between a pair of launch ramps.

Referring now to FIG. 10, passengers are transported through a watercourse including a guide structure 118 formed in a dual "Figure Eight" pattern submerged in the watercourse and extending in a closed loop through the watercourse. The passenger boats are guided over elevated jump ramps 120, 132 along one portion of the watercourse, and on return, the passenger boats are guided beneath the jump ramps through underground tunnel structures 134,136.

Figure 12:
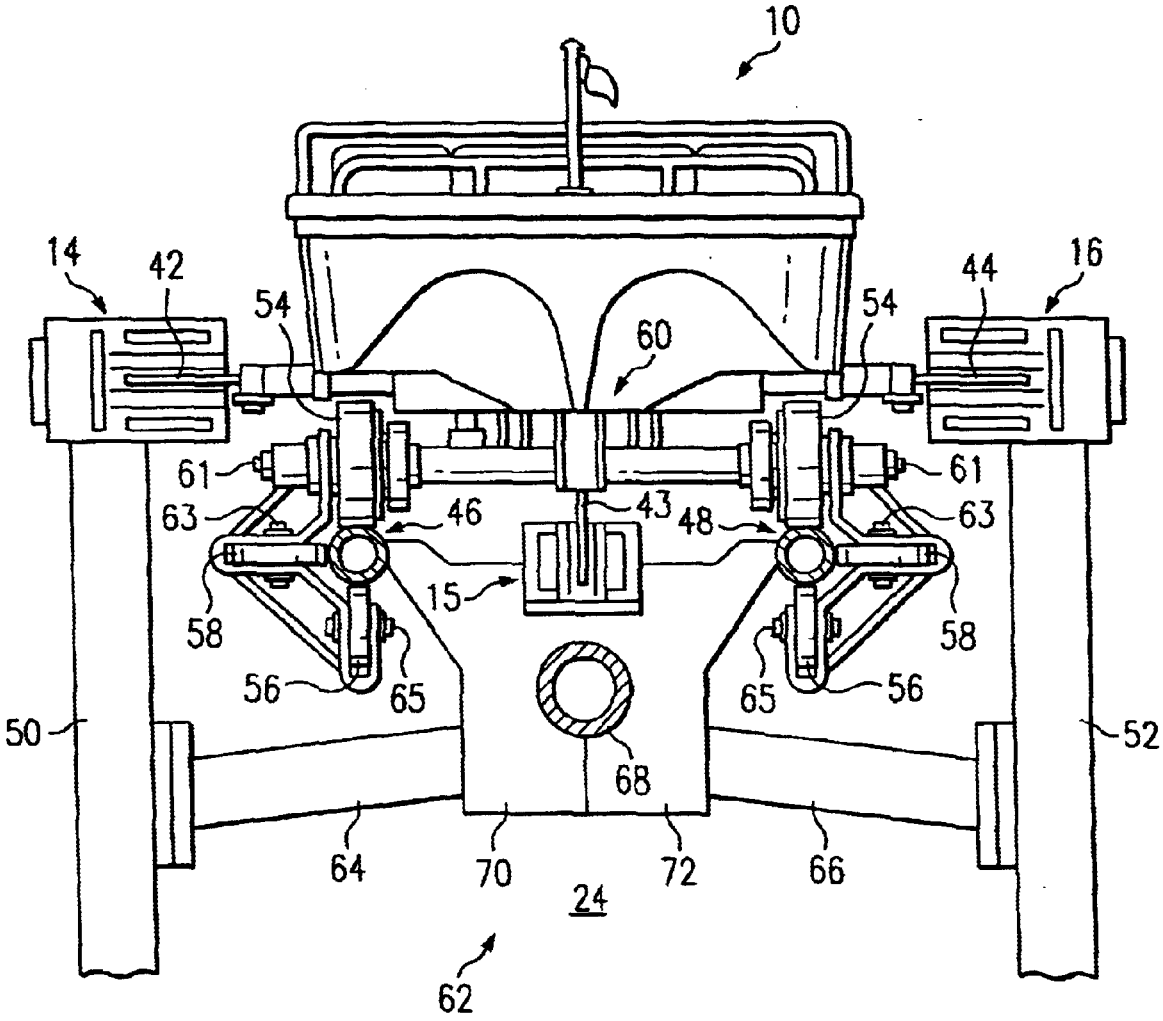
FIG. 12 is a view similar to FIG. 3 which illustrates a passenger boat mounted on guide rails and coupled to the flux slot of a linear induction stator by a downwardly projecting reaction plate.

Referring now to FIG. 12, a magnetically responsive reaction plate 43 is attached to the undercarriage 60 that supports the passenger boat. In this embodiment, the reaction plate 43 projects beneath the passenger boat for longitudinal travel through the flux slot of a stator 15 that is mounted on the submerged guide structure 62. The reaction plate 43 is responsive to magnetic flux produced by the induction stator 15 for propelling the passenger boat along the guide structure.

Typical construction specifications for the simulated boat race and passenger boat climb amusement rides are given in TABLE 1 and TABLE 2 below.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

TABLE 1

| SIMULATED BOAT RACE | |
|---|---|
| Ground Space Requirements | 500 × 60 Ft. |
| Launch Chute Length | 100 Ft. |
| Brakes - linear induction motor control | |
| Propulsion - 160 linear induction motors in each propulsion group for launch, hydroplaning and coasting speeds | |
| Positioning - guide wheels, centering wheels under the boat | |
| Guide Channel Length | 300 Ft. |
| Boat Speed (Hydroplaning) | 40 M.P.H. |
| Number of Guide Channels | 2 |
| Boat Length | 25 Ft. |
| Boat Width | 8 Ft. |
| Passengers per Boat | 24 to 26 |
| Acceleration - 1.5 G during launch | |
| Peak Electrical Power - 1,000 amperes per phase at 480 VAC, 3-phase, 60 Hz | |

TABLE 2

| PASSENGER BOAT CLIMB | |
|---|---|
| Ground Space Requirements | 400 × 60 Ft. |
| Dock Lengths | 50 Ft. |
| Positioning - guide wheels, centering wheels under the boat | |
| Guide Channel Length | 200 Ft. |
| Launch Chute Length | 100 Ft. |
| Launch Chute Elevation | 70 Ft. |
| Propulsion - 160 linear induction motors in each propulsion group for hydroplaning and coasting speeds; 200 linear induction motors in each propulsion group for climb and launch acceleration | |
| Boat Speed (Hydroplaning) | 40 M.P.H. |
| Number of Guide Channels | 2 |
| Boat Length | 25 Ft. |
| Boat Width | 8 Ft. |
| Passengers Per Boat | 24 to 26 |
| Acceleration - 1.5 G during launch | |
| Peak Electrical Power - 2,000 amperes per phase at 480 VAC, 3-phase, 60 Hz | |

I claim:

1. A method for operating an amusement boat ride in which passengers are transported on first and second passenger boats along a guide structure that is submerged in a watercourse, comprising the steps of moving the boats along the guide structure and controlling the movement of each boat relative to the other so that they approach and recede with respect to each other in opposite directions of travel at some location along the watercourse, and projecting water spray from one boat onto the other as the boats recede from each other.

2. A method for operating an amusement boat ride as set forth in claim 1, in which the guide structure includes first and second guide channels that extend generally in alignment with each other, including the step of moving the first and second passenger boats in opposite directions along the first and second guide channels, respectively.

3. A method for operating an amusement boat ride as set forth in claim 1, in which the guide structure includes first and second guide channels extending between first and second launch stations, including the steps of launching the boats from the first and second launch stations, respectively and controlling the directions of travel and operating speeds of the first and second passenger boats so that the boats close toward each other and recede from each other while the boats are traveling in opposite directions along the first and second guide channels, respectively.

4. A method for operating an amusement boat ride as set forth in claim 1, in which the guide structure is disposed in an hour-glass pattern and including the step of controlling the operating speed of the boats so that they close toward each other near the midpoint of the hour-glass pattern, and in passing project water spray onto each other as they recede from each other.

5. A method of operating an amusement boat ride as set forth in claim 1, in which the guide structure is configured in a serpentine pattern having first and second sections extending between looped end portions, with the first and second sections of the guide structure being disposed generally in side-by-side relation with each other intermediate the looped end portions, including the steps of controlling the launching and operating speed of each boat relative to the other so that the boats approach and pass in close proximity to each other and then recede from each other as they travel along the first and second loop sections.

6. A method for operating an amusement boat ride in which passengers are transported on first and second passenger boats along first and second guide channels that are submerged in a watercourse, including the step of controlling the launching and operating speeds of the first and second passenger boats so that one boat overtakes and passes the other while the boats are traveling in the same direction along the first and second guide channels, respectively, and including the step of projecting water spray from one boat onto the other as one boat overtakes and passes the other.

* * * * *